US005725054A

United States Patent [19]

Shayegi et al.

[11] Patent Number: 5,725,054

[45] Date of Patent: Mar. 10, 1998

[54] ENHANCEMENT OF RESIDUAL OIL RECOVERY USING A MIXTURE OF NITROGEN OR METHANE DILUTED WITH CARBON DIOXIDE IN A SINGLE-WELL INJECTION PROCESS

[75] Inventors: Sara Shayegi; Philip A. Schenewerk; Joanne M. Wolcott, all of Baton Rouge, La.

[73] Assignee: Board of Supervisors of Louisiana State University and Agricultural & Mechanical College, Baton Rouge, La.

[21] Appl. No.: 700,796

[22] Filed: Aug. 21, 1996

Related U.S. Application Data

[60] Provisional application No. 60/032,798 Aug. 22, 1995.

[51] Int. Cl.[6] ..... E21B 43/16; E21B 43/18

[52] U.S. Cl. ..... 166/263; 166/305.1

[58] Field of Search ..... 166/263, 305.1, 166/401, 402

[56] References Cited

U.S. PATENT DOCUMENTS

| | | | |
|---|---|---|---|
| 3,295,601 | 1/1967 | Santourian | 166/263 |
| 3,411,583 | 11/1968 | Holm et al. | 166/305.1 |
| 3,547,199 | 12/1970 | Froning et al. | 166/305.1 |
| 3,841,406 | 10/1974 | Burnett | 166/305.1 |
| 4,465,136 | 8/1984 | Troutman | 166/263 |
| 4,565,249 | 1/1986 | Pebdani et al. | 166/303 |
| 5,413,177 | 5/1995 | Horton | 166/305.1 X |

OTHER PUBLICATIONS

"Cyclic Injection of Rich Gas Into Producing Wells to Increase Rates from Viscous–Oil Reserves", J. of Petroleum Technology; Shelton and Morris; Aug., 1973.

"Well Stimulation by CO2 in the Heavy Oil field of Camurlu in Turkey", 5th SPE/DOE Symposium on Enhanced Oil Recovery; Bardon, et al.; Apr. 1986.

"Design and Implementation of Immiscible Carbon Dioxide Displacement Projects (CO2 Huff–Puff) in South Louisiana", 61st SPE Annual Conf.; Palmer, et al.; Oct., 1986.

"CO2 Huff 'n' Puff Process in a Bottomwater–Drive Reservoir", J. of Petroleum Technology; Simpson, M.R.; Jul., 1988.

"A Laboratory and Field Evaluation of the CO2 Huff 'n' Puff Process for light Oil Recovery", SPE Reservoir Engineering; Monger and Coma; Nov., 1988.

"A Flue Gas Huff 'n' Puff Process for Oil Recovery from Shallow Formations", 7th SPE/DOE Symposium on Enhanced Oil Recovery; Johnson, et al., Apr., 1990.

"A Laboratory Study of Natural Gas Huff 'n' Puff", 1990 CIM/SPE International Technical Meeting; Haines and Monger; Jun., 1990.

"Light Oil Recovery from Cyclic CO2 Injection: Influence of Low Pressures, Impure CO2, and Reservoir Gas", SPE Reservoir Engineering; Monger, et al.; Feb., 1991.

"Exhaust Gas Provides Alternative Gas Source for Cyclic EOR", Oil & Journal; Stoeppelwerth, G.P.; Apr. 1993.

*Primary Examiner*—George A. Suchfield

*Attorney, Agent, or Firm*—John H. Runnels; Warner J. Delaune

[57] ABSTRACT

A method for recovering oil from a subterranean formation penetrated by a well is provided, comprising the steps of injecting via the well a gas mixture into the formation, the gas mixture comprising carbon dioxide and a gas selected from the group consisting of methane, nitrogen, or mixtures thereof; wherein the gas mixture is injected in an amount sufficient to establish in the vicinity of the well a zone of oil in contact with the gas mixture; and wherein the carbon dioxide comprises about 5 percent to about 50 percent by volume at reservoir conditions of the gas mixture; shutting in the well for a predetermined period of time; and producing the well and recovering the residual oil from the formation. Alternatively, an amount of carbon dioxide may first be injected, followed by a slug of gas to form a gas mixture with the carbon dioxide, wherein the gas is methane, nitrogen, or mixtures thereof; and wherein the carbon dioxide comprises about 5 percent to about 50 percent by volume at reservoir conditions of the gas mixture. The steps in either of the above processes are cyclically repeated until further production of oil from the formation becomes uneconomical.

7 Claims, 2 Drawing Sheets

ENHANCEMENT OF RESIDUAL OIL RECOVERY USING A MIXTURE OF NITROGEN OR METHANE DILUTED WITH CARBON DIOXIDE IN A SINGLE-WELL INJECTION PROCESS

This application claims the benefit of U.S. Provisional Application No. 60/032,798, having an effective filing date of Aug. 22, 1995, which was converted from U.S. Ser. No. 08/517,812, filed on Aug. 22, 1995.

BACKGROUND OF THE INVENTION

I. Field of the Invention

This invention relates generally to methods for oil recovery from subterranean oil-bearing formations, and more particularly to such methods which employ cyclic gas stimulation techniques for the enhanced recovery of oil from a single well.

II. Prior Art

Cyclic gas stimulation is a single-well enhanced oil recovery (EOR) process which involves the injection of a designated volume of gas into an oil well. The equipment required for injection is usually less than that required for most workover operations. After gas injection, the well is shut-in for a "soak" period to allow time for the gas to migrate into the reservoir and dissolve in the oil in the immediate area surrounding the well, after which the well is reopened for production. Only minor modifications to existing production facilities such as rerouting of existing piping and installation of additional monitoring equipment are needed for the production phase of the operation.

Most EOR methods involve the displacement of solvents or chemicals from an injection well through the reservoir to a production well, in so-called well-to-well processes. This is usually accomplished with some type of repeating injection-production well pattern. For example, the five-spot pattern has four production wells at the corners of a square and an injection well in the center of the square. Because of the large initial investment required, projects of this nature are typically limited to large continuous reservoirs managed by major oil companies.

Few large-scale EOR processes have been implemented in Louisiana since a majority of the state's oil reserves are controlled by small oil companies with limited financial resources. The smaller independent companies often cannot afford the considerable initial investments and long pay-out periods associated with conventional large-scale EOR processes. In addition, numerous reservoirs in Louisiana and other states are not suited to large-scale projects since mobilization of oil from injection to production wells is inefficient or impossible in the discontinuous, highly-faulted, and often single-well reservoirs associated with Gulf coast saltdome-related geology.

There are several advantages to implementing cyclic gas stimulation as compared to other types of EOR processes. For example, the environmental impact of the process is negligible since the equipment requirements are minimal, the vented gas is non-toxic, and the process employs relatively small gas slugs. Furthermore, the economic risk is much less than that associated with other types of EOR processes which typically require much higher up-front investments and experience much longer project lives. In addition, cyclic injection processes may be the only EOR option for small or discontinuous reservoirs.

Cyclic $CO_2$ stimulation, which is also known as $CO_2$ "huff 'n' puff", is the most common cyclic gas stimulation process. It was originally proposed as an alternative to cyclic steam injection for the recovery of heavy crude. Numerous field tests conducted in Louisiana and other states have demonstrated that cyclic $CO_2$ injection may be implemented under diverse reservoir conditions, is economically feasible at oil prices as low as $15 per barrel, and has a minimal impact on the environment.

Although results indicate that cyclic $CO_2$ stimulation may be successfully implemented under a variety of conditions, application of $CO_2$ processes offshore, and in certain isolated locations onshore, are limited due to $CO_2$ transportation costs. Offshore application of $CO_2$ is additionally hindered due to difficulties in isolating $CO_2$ contamination, and the resulting corrosion to oilfield equipment.

Gases other than $CO_2$ have been employed to a wide extent in full-scale well-to-well EOR processes. The gases that have been used include methane, rich gas, nitrogen, and flue gas. Methane and rich gas are non-corrosive, and are frequently available from production streams. Nitrogen is also non-corrosive, and there are inexpensive procedures available for extraction of nitrogen from air. Flue (or engine exhaust) gas is a product of combustion which is primarily nitrogen mixed with 10–20% $CO_2$, and is generated by combustion facilities, such as power plants. For example, the 1992 *Oil and Gas Journal* Report on enhanced oil recovery projects showed that the contributions to 1992 U.S. EOR production from $CO_2$ hydrocarbon, nitrogen, and flue gas flooding (primarily well-to-well processes) were 145,068, 113,072, 22,580, and 11,000 bbl/day, respectively. The total EOR production from gas flooding was 298,020 bbl/day which represented over 39% of the total U.S. EOR production in 1992. Thermal processes contributed over 460,000 bbl/day to the total U.S. EOR production, but those processes are primarily utilized for the recovery of heavy California crude, and environmental restrictions are curtailing applications of thermal processes. It is therefore anticipated that gas flooding processes will become even more important in the future.

Despite the wide-spread use of methane and nitrogen in well-to-well EOR processes, there are only a limited number of reports concerning the use of gases other than $CO_2$ in the single-well cyclic stimulation process. For example, a paper by Haines and Monger presented at the 1990 CIM/SPE International Technical Meeting examined the feasibility of cyclic natural gas injection for the recovery of light oils. The natural gas employed in the study was primarily methane contaminated with less than 2 % nitrogen, $CO_2$, and ethane. Core flood and numerical simulation results indicated that the natural gas huff 'n' puff process was a technically and economically feasible EOR option, and that repressurization and gas relative permeability hysteresis were the most important recovery mechanisms.

Shelton and Morris, in an August, 1973, article in the Journal of Petroleum Technology, utilized cyclic rich gas injection to improve production rates in viscous oil reservoirs. The rich gas employed in the field test consisted of methane enriched with propane. Field test results indicated that rich gas could be used to increase the oil recovery rates of viscous oils, however some wells did not show significant responses. The most important recovery mechanisms were oil viscosity reduction and increased reservoir energy.

Bardon, et al., in a paper presented at the 1986 SPE/DOE Symposium on Enhanced Oil Recovery, evaluated cyclic injection of a gas mixture for improving the recovery of a heavy oil. The gas was obtained from a formation underlying the oil-bearing zone and consisted of $CO_2$ (73%), $N_2$ (6.2%), $CH_4$ (5.6%), $C_2H_6$ (13.8%), and $C_{3+}$ (1.4%). Cyclic gas injection was found to increase well productivity.

No studies regarding the use of pure nitrogen for cyclic injection have been found in the literature, although the use of flue gas has been investigated. Flue gas is the product of combustion processes in the burning of such gases as methane or propane, and is primarily nitrogen with 10–15% $CO_2$. Johnson, et al., and Clark, et al., in separate studies, employed cyclic flue gas injection for the improved recovery of moderate and heavy oils under miscible conditions. Field test results indicated that the flue gas huff 'n' puff method can be cost-effective at moderate oil prices. However, the disadvantages of using flue gas are that: (1) facilities are needed to generate the flue gas, (2) the flue gas must be treated to remove oxygen and nitrogen oxides in order to prevent undesirable corrosion, and (3) the $N_2/CO_2$ ratio cannot be easily varied or controlled.

Although this invention relates to secondary and tertiary oil recovery processes for single-well sites, a brief explanation of the factors involved in recovery for both single-well processes and well-to-well processes will be provided. As a result, the requirements for practicing the present invention, and the differentiation of the invention from prior well-to-well methods, will be better understood by those of ordinary skill.

Researchers initially assumed that the oil recovery mechanisms for cyclic stimulation and well-to-well gas flooding were similar. Well-to-well gas floods yield the most favorable results under miscible displacement conditions. Under miscible displacement conditions, oil is efficiently swept from the pore space, and an oil bank is formed at the leading edge of the solvent front. Although miscible displacement is theoretically capable of recovering 100% of residual oil under ideal conditions, actual recoveries are somewhat lower. Effects such as "gravity override" (gas has a lower density than oil and rises to the upper portion of the reservoir bypassing oil in the lower regions of the reservoir) or channeling (gas has a lower viscosity than oil and channels through the oil bypassing regions that contain oil) impair well-to-well displacement efficiencies.

Two fluids are considered to be miscible if they form a single phase when mixed together in any proportion. Water and ethyl alcohol are examples of miscible liquids; whereas, oil and water are examples of immiscible liquids. Fluids that form a single phase with reservoir oil immediately after injection into a reservoir are "first-contact" miscible. Some fluids, such as $CO_2$, that are not first contact-miscible may strip volatile components from the oil as they travel through the reservoir, and the resulting mixture of injection fluid and oil components may become miscible with the reservoir oil. A process in which miscibility is developed through repeated contacts of injection fluid with reservoir oil is termed "multiple-contact" miscible.

The development of multiple-contact miscibility is governed by the nature of the injection fluid, the nature of the oil, and the reservoir pressure and temperature. The minimum miscibility pressure (MMP) is the minimum pressure at which an oil and injection fluid at reservoir temperature can attain multiple-contact miscibility. The MMP's for carbon dioxide are considerably lower than those for methane and nitrogen. Consequently, carbon dioxide is typically the gas of choice in miscible displacements unless the reservoir pressure is high and methane or nitrogen are less expensive.

Reservoir conditions with respect to carbon dioxide (or gas) flooding may be divided into three regimes depending on the degree of miscibility: miscible, near-miscible, and immiscible. In the case of carbon dioxide, miscible means that the reservoir pressure is above the MMP for that gas. Near-miscible indicates that the carbon dioxide density is high, ranging up to 0.6 $kg/m^3$, but that reservoir pressure is below the MMP. Immiscible means that the reservoir pressure is not only below the MMP, but is also below the vapor pressure of carbon dioxide.

Prior to the specific discoveries made in connection with this invention, laboratory core floods were performed to examine the effects of miscibility on the cyclic $CO_2$ stimulation process. $CO_2$ utilization (the volume, Mscf, of gas required to recover one barrel of oil) improved as $CO_2$ density (or pressure) decreased; however, recovery efficiency increased as the $CO_2$ density rose until the system became miscible. At pressures above the MMP, recovery efficiency decreases as pressure increased.

As pressure decreased, the reservoir volume occupied by a fixed mass of carbon dioxide increased due to expansion of the gas, thus a larger volume of oil was contacted by carbon dioxide. Alternatively, as pressure increased, the solubility of carbon dioxide in the oil increased, and thus the efficiency of oil displacement improved. At miscible conditions, the displacement of oil was so efficient that oil was displaced away from the injection site during carbon dioxide injection, and was difficult to recover during the production phase. At near-miscible conditions, the carbon dioxide/oil interactions were less extensive, and carbon dioxide bypassed oil during the injection phase. The carbon dioxide dissolved in the oil during the soak phase, and oil was efficiently recovered. The overall process performance was, therefore, assessed to be adequate at near-miscible and immiscible conditions, but poor at miscible conditions.

Laboratory experiments also demonstrated that gas override benefitted cyclic carbon dioxide process performance. At experimental conditions, the density of carbon dioxide was an order of magnitude smaller than that of oil or water. If the core remained stationary, the lower density of the carbon dioxide allowed it to migrate along the top of the core during injection. This apparently resulted in effective bypassing of oil by carbon dioxide during carbon dioxide injection, which produced a deeper distribution of carbon dioxide in the core. Rotation of the core during carbon dioxide injection minimized gravity segregation, and inhibited deeper penetration of carbon dioxide into the core, which ultimately resulted in less oil being contacted and altered by the carbon dioxide.

Other experiments suggested that a well-distributed initial gas saturation improves cyclic carbon dioxide process performance. Presumably, an initial gas saturation favors oil recovery by providing a flow path for the carbon dioxide, thus allowing deeper penetration into the core.

The results of these experiments indicated that cyclic gas injection and well-to-well displacement processes function by considerably different oil recovery mechanisms. Examination of the cyclic carbon dioxide stimulation process by analysis of laboratory core flood, computer simulation, and field-test results have attributed improved oil recovery to one or more of the following factors:

1. Oil viscosity reduction
2. Oil swelling
3. Solution-gas drive
4. Altered relative permeability from reduced water saturations, drainage/imbibition hysteresis, and/or wettability change
5. Hydrocarbon vaporization or extraction
6. Interfacial tension reduction
7. Rock dissolution Although viscosity reduction has been shown to be an important mechanism in the recovery of heavy oils, studies have indicated that it had a lesser effect on the recovery of light oils. Oil swelling may be significant at higher pressures, but has only minor effects at lower pressures.

Results suggest that solution-gas drive and hydrocarbon vaporization or extraction are not significant recovery mechanisms. The most recent results suggest that relative permeability effects are the most important factors that influence oil recovery.

SUMMARY OF THE INVENTION

It is therefore an object of this invention to provide a method for recovering oil which results in the recovery of greater amounts of oil from subterranean formations.

It is also an object of this invention to provide a method for recovering oil which is more cost effective than prior methods.

It is a further object of this invention to provide a method of recovering oil which permits less reliance on carbon dioxide than prior methods.

Still another object of this invention is to provide a method for recovering oil which employs immiscible gas mixtures for the displacement of oil.

Yet another object of this invention is to provide a method for recovering oil which provides various combinations of the preceding advantages.

These and other objects and advantages of the present invention will no doubt become apparent to those skilled in the art after having read the following description of the invention.

Therefore, in a preferred embodiment, a method for recovering oil from a subterranean formation penetrated by a well is provided, comprising the steps of injecting via said well a gas mixture into said formation, said gas mixture comprising carbon dioxide and a gas selected from the group consisting of methane, nitrogen, and mixtures thereof; wherein said gas mixture is injected in an amount sufficient to establish in the vicinity of said well a zone of oil in contact with said gas mixture; and wherein said carbon dioxide comprises about 5 percent to about 50 percent by volume at reservoir conditions of said gas mixture; shutting in said well for a predetermined period of time; and producing said well and recovering said oil from said formation. Alternatively, an amount of carbon dioxide may first be injected in an amount sufficient to establish in the vicinity of said well a zone of oil in contact with said carbon dioxide, followed by a slug of gas to form a gas mixture with said carbon dioxide, wherein said gas is selected from the group consisting of methane, nitrogen, and mixtures thereof; and wherein said carbon dioxide comprises about 5 percent to about 50 percent by volume at reservoir conditions of said gas mixture. Optionally, either the carbon dioxide or the gas is injected at a pressure below the minimum miscibility pressure of carbon dioxide. The above steps are cyclically repeated until further production of oil from the formation becomes uneconomical.

DETAILED DESCRIPTION OF THE INVENTION

Figure 1:
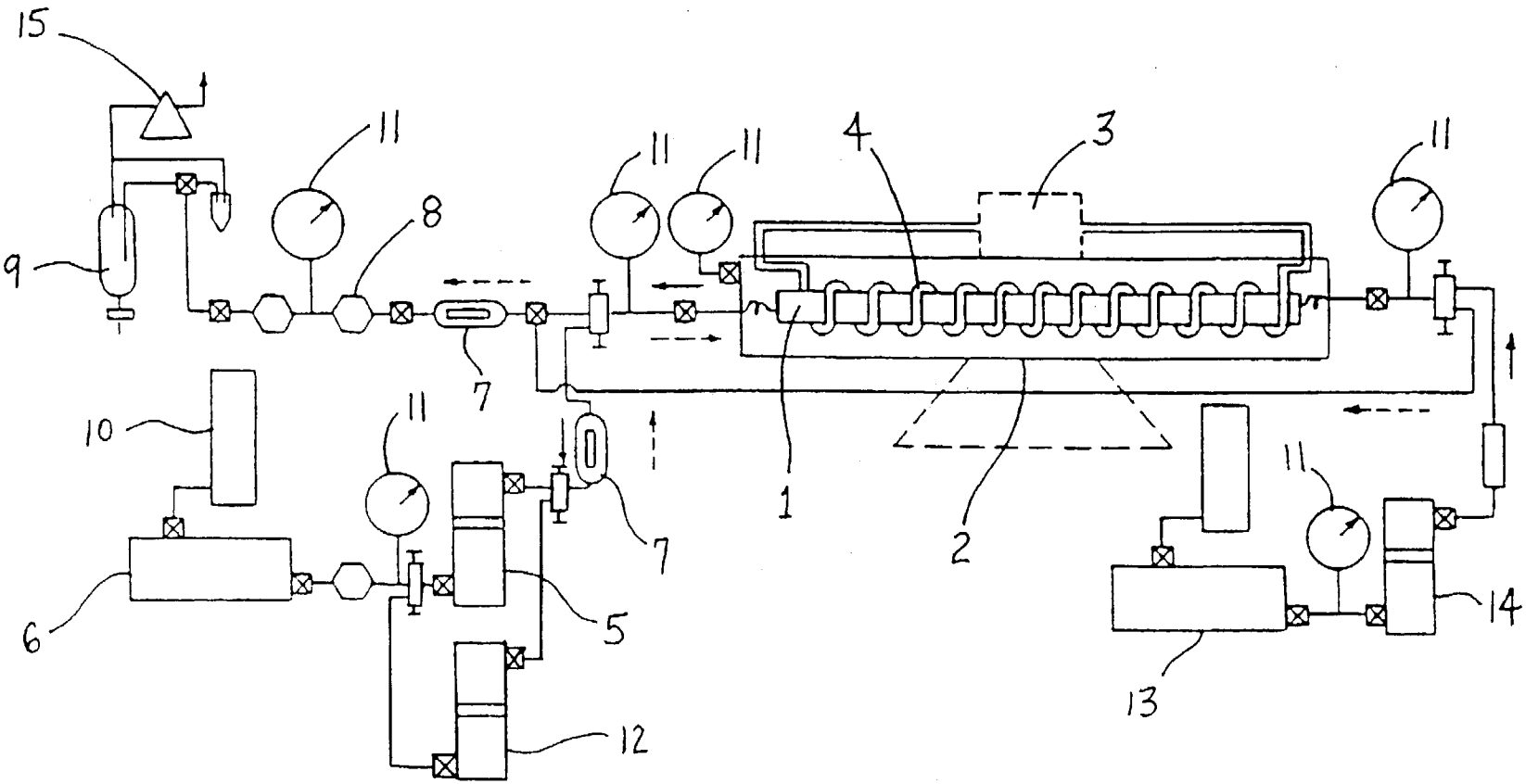
FIG. 1 is a schematic diagram of the core testing equipment used in the experiments.

In a preferred embodiment, the present invention comprises the steps of injecting a gas mixture into an oil-bearing formation through a well which traverses the formation, wherein the gas mixture includes either methane and carbon dioxide, or nitrogen and carbon dioxide. When either of these mixtures is employed, the methane or the nitrogen (as applicable) is predominantly present. Alternatively, the same amount of carbon dioxide that would have been present in the gas mixture may be first injected into the well, followed by the injection into the same well of an amount of methane or nitrogen that would have been present in the mixture. Preferably, the well is shut-in for an appropriate soaking period, after which the oil is produced from the formation.

Extensive experimentation indicated that methane or mixtures of methane/carbon dioxide or nitrogen/carbon dioxide could potentially surpass the cyclic stimulation performance of carbon dioxide, especially when those mixtures contain fairly low levels of carbon dioxide. A first set of experiments examined the cyclic injection performance of methane/carbon dioxide gas mixtures as well as nitrogen/carbon dioxide mixtures. The results indicated that oil recovery due to a first cycle of gas mixture injection typically increased over that of any gas alone when the percent of carbon dioxide in the gas mixture was 50% or less. When both cycles of gas mixture injection were taken into consideration, the overall recovery improved dramatically when the mixture was primarily either methane or nitrogen.

In another set of experiments, nitrogen or methane was used as a chase (or drive) gas. When carbon dioxide injection was followed by a slug of either nitrogen or methane, there was an enormous improvement in process performance over that produced by any of those gases alone. Although both of the above sets of experiments indicated that there were benefits to be gained by adjusting the composition of the gas slug with varying ratios of carbon dioxide and either nitrogen or methane, the results were surprising since the experiments and the results contradicted popular theories, and repeated experiments gave substantially similar results.

EXPERIMENTAL PROCEDURE

A light crude oil obtained from the Timbalier Bay field in Lafourche Parish, La., was used for the core floods. The properties of this stock tank oil are listed in Table 1. The carbon dioxide used was 99.5 mol % pure, the nitrogen was 99.9 mol % pure, and the methane had a purity of 99.97 mol %. The properties of these gases are listed in Table 2.

TABLE 1

PROPERTIES OF TIMBALIER BAY

| | |
|---|---|
| Field Location | South Louisiana |
| Molecular Weight | |
| Freezing Point Depression | 225 |
| Gas Chromatography | 223 |
| Density at 60° F. and 1 atm, °API | 31.2 |
| gm/cm$^3$ | 0.87 |
| Viscosity at 75° F. and 1 atm, cp | 13 |
| Composition, wt % | |
| Saturates | 48.1 |
| Aromatics | 31.4 |
| Resins | 18.7 |
| Asphaltenes | 1.8 |
| $C_{15+}$ | 55.5 |

TABLE 2

PROPERTIES OF GASES

| Parameter | Nitrogen | Methane | $CO_2$ |
|---|---|---|---|
| Molec. weight | 28.013 | 16.043 | 44.010 |
| Boil. Point, K. | 77.2 | 111.63 | 194.65 |
| Triple Point, K. | 63.1 | 90.68 | 216.58 |
| Crit. Temp, K. | 126.3 | 190.53 | 304.21 |
| Crit. Pres, bar | 33.999 | 45.96 | 73.825 |
| Density, g/cc* | 0.03381 | 0.02031 | 0.06344 |
| Comp. Factor* | 0.9966 | 0.9501 | 0.8345 |

*At 30.0 bar and 300.0 K.

A detailed description of the apparatus used to perform the horizontal core floods appears in FIG. 1. The cores 1 used were consolidated Berea sandstone with an average diameter of 2 inches and a length of 6 feet. The core 1 was coated with an epoxy resin prior to installation in an insulated stainless steel cylindrical core holder 2. The annulus of the core holder 2 was filled with hydraulic oil and maintained at a pressure of about 1000 psi greater than the core pressure to ensure the integrity of the epoxy coating. The temperature of the core 1 was maintained constant using a temperature controller 3 and an ethylene glycol-water mixture circulated in tubes 4 wrapped around the core 1.

Floating piston transfer vessels 5 were used in conjunction with a positive displacement pump 6 to inject liquids (oil or brine) into the core 1. At both the inlet and outlet ends of the core 1, high-pressure sight glasses 7 allowed the observation of injected and displaced fluids. The outlet end of the core 1 was connected to a production panel via a back pressure regulator 8 used to maintain core pressure. Oil and water were collected at atmospheric pressure and room temperature within flash separator 9. Gas was measured using a gasometer 15, and inlet and outlet pressures were monitored by digital meters and Bourdon tube gauges 11.

Between experiments, cores 1 were cleaned using isopropyl alcohol and xylene and then saturated with a 5 wt. % NaCl brine solution. The core 1 was oil-flooded to irreducible water saturation and then water-flooded to residual oil saturation. The water aquifer for the reservoir was modeled by a brine-filled transfer vessel 12 connected to the core and maintained at a constant pressure.

A typical immiscible cyclic single gas stimulation experiment consisted of injecting a slug of gas (supercritical or gaseous carbon dioxide, gaseous nitrogen or methane) in the designated "huff" direction at 1600 psig (or 500 psig where noted) and at room temperature. A positive displacement mercury pump 13 and another transfer vessel 14 were used to inject the gas. The slug size was designed so that during the huff, only brine was displaced into the transfer vessel 12. Similar reservoir volumes of gas were utilized for comparative purposes. If the injection pressure was 1600 psig, the pressure in the core was slowly lowered over a 7-hour period until it reached 500 psig. The core was then shut-in for a 10-hour soak period. If gas was injected at 500 psig, the core was shut-in immediately for the 10-hour soak. During the "puff", brine was pumped from the transfer vessel 12 into the core in the opposite direction of the injection. Oil recovery efficiencies were calculated by volumetric material balance. Generally, a second cycle of gas was injected upon cessation of oil production from the first cycle. The second cycle was performed as was the first cycle with the exception that in some experiments the injection pressure was 500 psig, and no depressurization was necessary. For mixtures of carbon dioxide and nitrogen or methane, experiments were performed at either 1600 or 500 psig so that either only a gas phase was present (i.e., at 500 psig) or a mixture of gas and a supercritical fluid.

Figure 2:
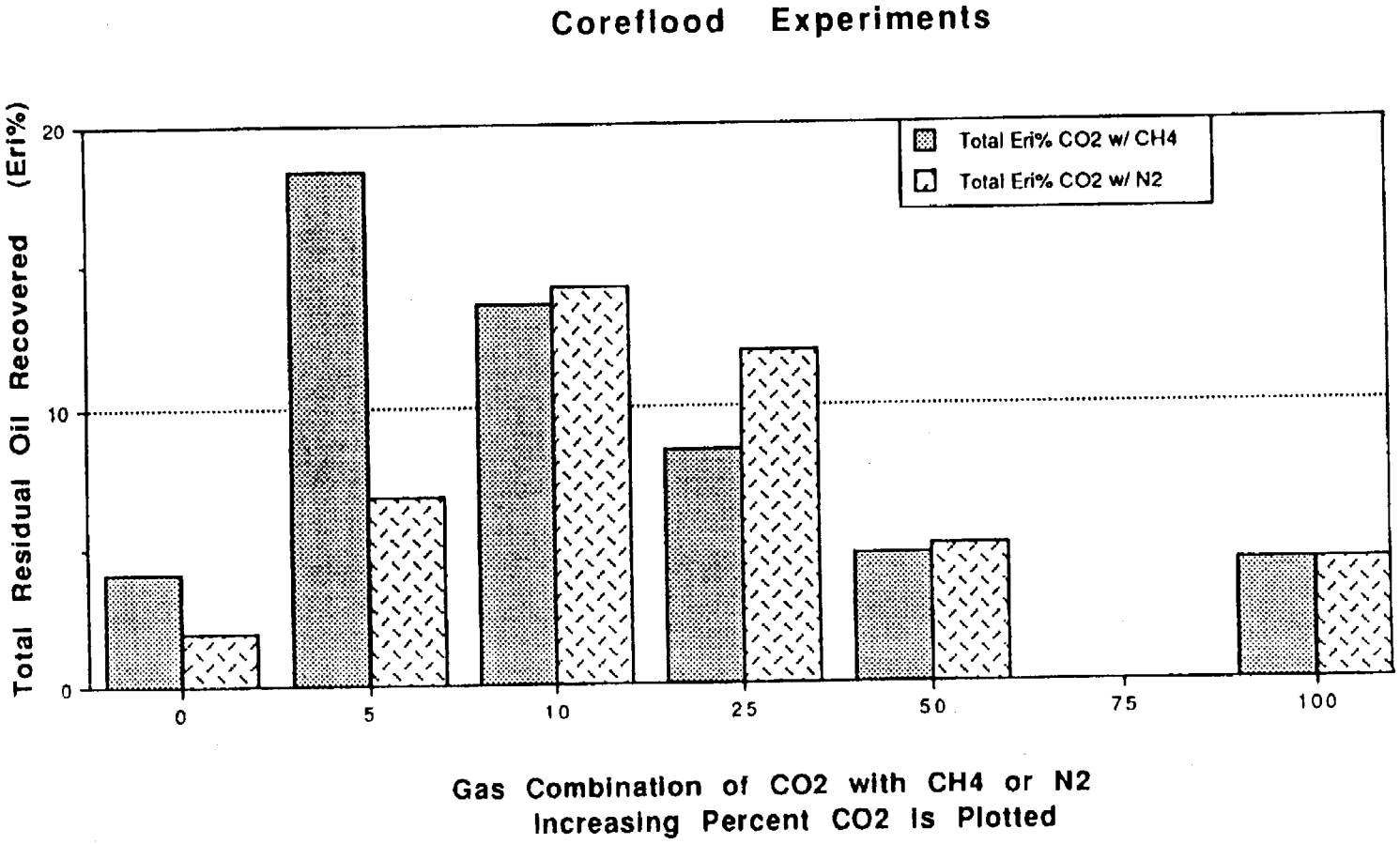
FIG. 2 is a bar graph depicting the relationship between the total residual oil recovery as a function of carbon dioxide percentage in both methane and nitrogen gas mixtures.

Table 3 lists the conditions for each experimental run, while Table 4 provides a summary of the experimental results. Finally, FIG. 2 is a bar graph depicting the oil recovery as a function of carbon dioxide percent with both methane and nitrogen. In all of the experiments conducted, the percentage of carbon dioxide is indicated as a percentage by volume at reservoir conditions of the total gas injected into the formation. The symbols used in the tables are defined as follows:

| | |
|---|---|
| $K_{huff}$, $K_{puff}$ | Absolute permeability measured in the huff or puff direction (md) |
| $P_{inj}$ | Pressure (psig) of injection |
| $T_{inj}$ | Temperature (°F.) of injection |
| Produced at P | Pressure (psig) at production |
| $S_{oi}$ | Initial oil saturation (%) |
| $S_{orwf}$ | Oil saturation after water flood (%) |
| $E_{rw}$ | Oil recovery - fraction of oil in place (water flood) (%) |
| $E_{ri}$ | Oil recovery - fraction of oil in place (gas flood) (%) |
| Total $E_{ri}$ | Sum of $E_{ri}$ for first and second cycle (%) |
| $E_{rr}$ | Oil recovery - fraction of oil saturation after $H_2O$ flood (gas flood) (%) |
| Total $E_{rr}$ | Sum of $E_{rr}$ for first and second cycle (%) |

TABLE 3

| Run # | Gas | Core | $K_{huff}$, md | $K_{puff}$, md | $P_{inj}$, psig | $T_{inj}$, °F. | $P_{production}$, psig |
|---|---|---|---|---|---|---|---|
| 163 | $CH_4$ | HCC5 | 212.0 | 159.0 | 1640 | 66.0 | 500 |
| 164 | $CH_4$ | HCC5 | | | 540 | 68.0 | 500 |
| 173 | $CH_4$ | HCC5 | 192.0 | 156.0 | 1640 | 81.0 | 500 |
| 174 | $CH_4$ | HCC5 | | | 500 | 81.0 | 500 |
| 147[a] | 3–8% $CO_2$/$CH_4$ | HCC5 | 224.0 | 210.2 | 1640 | 82.0 | 500 |
| 148[a] | 3–8% $CO_2$/$CH_4$ | HCC5 | | | 540 | 82.0 | 500 |
| 151[a] | 3–8% $CO_2$/$CH_4$ | HCC5 | 242.0 | 204.3 | 1640 | 77.5 | 500 |
| 152[a] | 3–8% $CO_2$/$CH_4$ | HCC5 | | | 542 | 78.0 | 500 |
| 181 | 10% $CO_2$/$CH_4$ | HCC5 | 139.0 | 157.0 | 1600 | 77.0 | 500 |
| 182 | 10% $CO_2$/$CH_4$ | HCC5 | | | 1600 | 76.0 | 500 |
| 183 | 10% $CO_2$/$CH_4$ | HCC5 | 181.0 | 164.0 | 1600 | 73.0 | 500 |
| 184 | 10% $CO_2$/$CH_4$ | HCC5 | | | 1600 | 71.2 | 500 |
| 201 | 10% $CO_2$/$CH_4$ | HCC5 | 141.0 | 138.0 | 1600 | 78.0 | 1600 |
| 202 | 10% $CO_2$/$CH_4$ | HCC5 | | | 1600 | 79.0 | 1600 |
| 193 | 25% $CO_2$/$CH_4$ | HCC5 | 172.0 | 198.0 | 1600 | 74.0 | 500 |
| 194 | 25% $CO_2$/$CH_4$ | HCC5 | | | 1600 | 74.0 | 500 |
| 167[a] | 50% $CO_2$/$CH_4$ | HCC5 | 187.4 | 173.2 | 500 | 73.1 | 500 |
| 168[a] | 50% $CO_2$/$CH_4$ | HCC5 | | | 500 | 71.5 | 500 |
| 175[a] | 50% $CO_2$/$CH_4$ | HCC5 | 195.9 | 178.4 | 500 | 80.0 | 500 |
| 176[a] | 50% $CO_2$/$CH_4$ | HCC5 | | | 500 | 80.0 | 500 |
| 179[a] | 50% $CO_2$/$CH_4$ | HCC5 | 223.5 | 180.4 | 500 | 80.0 | 500 |
| 180[a] | 50% $CO_2$/$CH_4$ | HCC5 | | | 500 | 80.0 | 500 |
| 189 | 50% $CO_2$/$CH_4$ | HCC5 | 194.0 | 208.0 | 1600 | 73.0 | 500 |

TABLE 3-continued

| Run # | Gas | Core | $K_{huff}$, md | $K_{puff}$, md | $P_{inj}$, psig | $T_{inj}$, °F. | $P_{production}$, psig |
|---|---|---|---|---|---|---|---|
| 190 | 50% $CO_2$/$CH_4$ | HCC5 | | | 1600 | 73.0 | 500 |
| 187 | $CO_2$ | HCC7 | 240.7 | 295.0 | 1600 | 75.0 | 500 |
| 188 | $CO_2$ | HCC7 | | | 500 | 73.0 | 500 |
| 155 | $CO_2$ | HCC5 | 207.0 | 178.0 | 1640 | 84.0 | 500 |
| 156 | $CO_2$ | HCC5 | | | 500 | 79.0 | 500 |
| 157 | $CO_2$ | HCC5 | 199.0 | 187.0 | 1640 | 81.0 | 500 |
| 158 | $CO_2$ | HCC5 | | | 500 | 77.0 | 500 |
| 135 | $N_2$ | HCC5 | 212.0 | 214.0 | 1640 | 75.0 | 500 |
| 136 | $N_2$ | HCC5 | | | 500 | 78.0 | 500 |
| 161 | $N_2$ | HCC5 | 204.0 | 215.0 | 1640 | 78.0 | 500 |
| 162 | $N_2$ | HCC5 | | | 540 | 76.0 | 500 |
| 165 | $N_2$ | VCC1 | 129.0 | 172.0 | 1600 | 71.0 | 500 |
| 166 | $N_2$ | VCC1 | | | 500 | 71.0 | 500 |
| 137[a] | 3–8% $CO_2$/$N_2$ | HCC5 | 202.6 | 222.9 | 1640 | 70.0 | 500 |
| 138[a] | 3–8% $CO_2$/$N_2$ | HCC5 | | | 580 | 71.0 | 500 |
| 142[a] | 3–8% $CO_2$/$N_2$ | HCC5 | 236.9 | 230.7 | 1640 | 78.0 | 500 |
| 143[a] | 3–8% $CO_2$/$N_2$ | HCC5 | | | 540 | 78.0 | 500 |
| 185 | 10% $CO_2$/$N_2$ | HCC5 | 199.4 | 146.8 | 1600 | 69.3 | 500 |
| 181 | 10% $CO_2$/$N_2$ | HCC5 | | | 1600 | 70.8 | 500 |
| 191 | 10% $CO_2$/$N_2$ | HCC7 | 218.0 | 262.0 | 1600 | 74.0 | 500 |
| 192 | 10% $CO_2$/$N_2$ | HCC7 | | | 1600 | 76.0 | 500 |
| 199 | 10% $CO_2$/$N_2$ | HCC7 | 236.0 | 271.0 | 1600 | 78.0 | 1600 |
| 200 | 10% $CO_2$/$N_2$ | HCC7 | | | 1600 | 78.0 | 1600 |
| 197[b] | 10% $CO_2$/$N_2$ | HCC7 | 251.0 | 279.0 | 1600 | 78.0 | 1600 |
| 198[b] | 10% $CO_2$/$N_2$ | HCC7 | | | 1600 | 78.0 | 1600 |
| 195 | 25% $CO_2$/$N_2$ | HCC7 | 254.0 | 319.0 | 1600 | 72.0 | 500 |
| 196 | 25% $CO_2$/$N_2$ | HCC7 | | | 1600 | 72.0 | 500 |
| 169[a] | 50% $CO_2$/$N_2$ | HCC5 | 217.5 | 205.8 | 500 | 73.8 | 500 |
| 170[a] | 50% $CO_2$/$N_2$ | HCC5 | | | 500 | 74.0 | 500 |
| 177[a] | 50% $CO_2$/$N_2$ | HCC5 | 215.5 | 186.5 | 500 | 78.0 | 500 |
| 178[a] | 50% $CO_2$/$N_2$ | HCC5 | | | 500 | 78.0 | 500 |
| 187 | $CO_2$ | HCC7 | 240.7 | 295.0 | 1600 | 750 | 500 |

TABLE 3-continued

| Run # | Gas | Core | $K_{huff}$, md | $K_{puff}$, md | $P_{inj}$, psig | $T_{inj}$, °F. | $P_{production}$, psig |
|---|---|---|---|---|---|---|---|
| 188 | $CO_2$ | HCC7 | | | 500 | 73.0 | 500 |
| 155 | $CO_2$ | HCC5 | 207.0 | 178.0 | 1640 | 84.0 | 500 |
| 156 | $CO_2$ | HCC5 | | | 500 | 79.0 | 500 |
| 157 | $CO_2$ | HCC5 | 199.0 | 187.0 | 1640 | 81.0 | 500 |
| 158 | $CO_2$ | HCC5 | | | 500 | 77.0 | 500 |

[a]Gases mixed before injection. For all other runs, $CO_2$ was injected first.

[b]Percentage of core volume occupied by gas was 8%. For all other experiments, it was about 22%.

TABLE 4

| Run # | Gas | Cycle | $S_{oi}$, % | $E_{rw}$, % | $S_{orwi}$, % | $E_{ri}$, % | Total $E_{ri}$, % | $E_{rr}$, % | Total $E_{rr}$, % |
|---|---|---|---|---|---|---|---|---|---|
| 163 | $CH_4$ | 1 | 68.4 | 48.7 | 35.1 | 2.92 | 3.80 | 5.70 | 7.41 |
| 164 | $CH_4$ | 2 | | | | 0.88 | | 1.71 | |
| 173 | $CH_4$ | 1 | 71.2 | 45.3 | 38.9 | 3.37 | 4.40 | 6.17 | 8.06 |
| 174 | $CH_4$ | 2 | | | | 1.03 | | 1.89 | |
| 147[a] | 3–8% $CO_2$/$CH_4$ | 1 | 68.8 | 46.5 | 36.8 | 4.26 | 22.77 | 7.97 | 11.43 |
| 148[a] | 3–8% $CO_2$/$CH_4$ | 2 | | | | 18.51 | | 3.46 | |
| 151[a] | 3–8% $CO_2$/$CH_4$ | 1 | 68.7 | 45.2 | 37.7 | 6.60 | 14.07 | 12.04 | 25.67 |
| 152[a] | 3–8% $CO_2$/$CH_4$ | 2 | | | | 7.47 | | 13.63 | |
| 181 | 10% $CO_2$/$CH_4$ | 1 | 69.3 | 51.3 | 33.7 | 5.00 | 14.60 | 10.28 | 30.04 |
| 182 | 10% $CO_2$/$CH_4$ | 2 | | | | 9.60 | | 19.76 | |
| 183 | 10% $CO_2$/$CH_4$ | 1 | 71.7 | 49.6 | 36.1 | 4.60 | 15.80 | 9.20 | 31.30 |
| 184 | 10% $CO_2$/$CH_4$ | 2 | | | | 11.20 | | 22.10 | |
| 201 | 10% $CO_2$/$CH_4$ | 1 | 67.3 | 48.9 | 34.4 | 8.32 | 10.70 | 16.28 | 20.93 |
| 202 | 10% $CO_2$/$CH_4$ | 2 | | | | 2.38 | | 4.65 | |
| 193 | 25% $CO_2$/$CH_4$ | 1 | 71.2 | 44.8 | 39.3 | 7.30 | 8.52 | 13.20 | 15.40 |
| 194 | 25% $CO_2$/$CH_4$ | 2 | | | | 1.22 | | 2.20 | |
| 167[a] | 50% $CO_2$/$CH_4$ | 1 | 69.2 | 46.6 | 36.9 | 1.16 | 4.44 | 2.17 | 8.31 |
| 168[a] | 50% $CO_2$/$CH_4$ | 2 | | | | 3.28 | | 6.14 | |
| 175[a] | 50% $CO_2$/$CH_4$ | 1 | 70.1 | 46.2 | 37.7 | 1.14 | 2.47 | 2.12 | 4.65 |
| 176[a] | 50% $CO_2$/$CH_4$ | 2 | | | | 1.33 | | 2.53 | |
| 179[a] | 50% $CO_2$/$CH_4$ | 1 | 71.2 | 46.8 | 37.9 | 2.43 | 3.83 | 4.58 | 7.22 |
| 180[a] | 50% $CO_2$/$CH_4$ | 2 | | | | 1.40 | | 2.64 | |
| 189 | 50% $CO_2$/$CH_4$ | 1 | 69.3 | 47.7 | 36.3 | 4.42 | 7.79 | 8.46 | 14.89 |
| 190 | 50% $CO_2$/$CH_4$ | 2 | | | | 3.37 | | 6.43 | |
| 187 | $CO_2$ | 1 | 66.6 | 40.6 | 39.6 | 3.57 | 5.31 | 6.02 | 8.95 |
| 188 | $CO_2$ | 2 | | | | 1.74 | | 2.93 | |
| 155 | $CO_2$ | 1 | 67.9 | 51.1 | 33.2 | 2.95 | 3.83 | 6.02 | 7.83 |
| 156 | $CO_2$ | 2 | | | | 0.88 | | 1.81 | |
| 157 | $CO_2$ | 1 | 66.1 | 51.8 | 31.9 | 2.82 | 3.83 | 5.86 | 7.95 |
| 158 | $CO_2$ | 2 | | | | 1.01 | | 2.09 | |
| 135 | $N_2$ | 1 | 68.6 | 47.6 | 36.0 | 1.26 | 1.55 | 2.41 | 2.97 |

TABLE 4-continued

| Run # | Gas | Cycle | $S_{oi}$, % | $E_{rw}$, % | $S_{orwi}$, % | $E_{ri}$, % | Total $E_{ri}$, % | $E_{rr}$, % | Total $E_{rr}$, % |
|---|---|---|---|---|---|---|---|---|---|
| 136 | $N_2$ | 2 | | | | 0.29 | | 0.56 | |
| 161 | $N_2$ | 1 | 66.7 | 49.6 | 33.6 | 1.20 | 1.90 | 2.38 | 3.76 |
| 162 | $N_2$ | 2 | | | | 0.70 | | 1.38 | |
| 165 | $N_2$ | 1 | 69.5 | 49.0 | 35.4 | 1.36 | 2.24 | 2.67 | 4.39 |
| 166 | $N_2$ | 2 | | | | 0.88 | | 1.72 | |
| 137[a] | 3–8% $CO_2/N_2$ | 1 | 68.5 | 54.1 | 31.4 | 2.92 | 5.55 | 6.36 | 12.09 |
| 138[a] | 3–8% $CO_2/N_2$ | 2 | | | | 2.63 | | 5.73 | |
| 142[a] | 3–8% $CO_2/N_2$ | 1 | 67.1 | 45.5 | 36.5 | 6.66 | 8.13 | 12.23 | 14.93 |
| 143[a] | 3–8% $CO_2/N_2$ | 2 | | | | 1.47 | | 2.70 | |
| 185 | 10% $CO_2/N_2$ | 1 | 70.9 | 47.9 | 36.9 | 6.40 | 12.00 | 12.30 | 23.10 |
| 181 | 10% $CO_2/N_2$ | 2 | | | | 5.60 | | 10.80 | |
| 191 | 10% $CO_2/N_2$ | 1 | 66.6 | 40.4 | 39.8 | 8.69 | 16.41 | 14.56 | 27.50 |
| 192 | 10% $CO_2/N_2$ | 2 | | | | 7.72 | | 12.94 | |
| 199 | 10% $CO_2/N_2$ | 1 | 68.2 | 39.6 | 41.2 | 10.19 | 14.34 | 16.88 | 23.76 |
| 200 | 10% $CO_2/N_2$ | 2 | | | | 4.15 | | 6.88 | |
| 197[b] | 10% $CO_2/N_2$ | 1 | 68.5 | 40.2 | 40.9 | 2.07 | 4.75 | 3.46 | 7.94 |
| 198[b] | 10% $CO_2/N_2$ | 2 | | | | 2.68 | | 4.48 | |
| 195 | 25% $CO_2/N_2$ | 1 | 66.6 | 41.5 | 38.9 | 6.98 | 11.96 | 11.92 | 20.43 |
| 196 | 25% $CO_2/N_2$ | 2 | | | | 4.98 | | 8.51 | |
| 169[a] | 50% $CO_2/N_2$ | 1 | 70.1 | 46.0 | 37.9 | 4.37 | 6.27 | 8.10 | 11.62 |
| 170[a] | 50% $CO_2/N_2$ | 2 | | | | 1.90 | | 3.52 | |
| 177[a] | 50% $CO_2/N_2$ | 1 | 69.7 | 47.8 | 36.4 | 0.96 | 3.73 | 1.83 | 7.14 |
| 178[a] | 50% $CO_2/N_2$ | 2 | | | | 2.77 | | 5.31 | |
| 187 | $CO_2$ | 1 | 66.6 | 40.6 | 39.6 | 3.57 | 5.31 | 6.02 | 8.95 |
| 188 | $CO_2$ | 2 | | | | 1.74 | | 2.93 | |
| 155 | $CO_2$ | 1 | 67.9 | 51.1 | 33.2 | 2.95 | 3.83 | 6.02 | 7.83 |
| 156 | $CO_2$ | 2 | | | | 0.88 | | 1.81 | |
| 157 | $CO_2$ | 1 | 66.1 | 51.8 | 31.9 | 2.82 | 3.83 | 5.86 | 7.95 |
| 158 | $CO_2$ | 2 | | | | 1.01 | | 2.09 | |

[a]Gases mixed before injection. For all other runs, $CO_2$ was injected first.
[b]Percentage of core volume occupied by gas was 8%. For all other experiments, it was about 22%.

It can be seen from the bar graph in FIG. 2 that both combinations of gases follow similar trends, with the oil recovery maximized at low carbon dioxide concentrations. The oil recovery peaks at a slightly lower carbon dioxide level when the inert gas is methane as compared to nitrogen. The reproducibility of the experimental results for runs conducted under similar conditions was acceptable.

In view of the foregoing experimental results, several comments and conclusions can be made. For gas flooding projects, five gases are generally considered: $CO_2$, $N_2$, $CH_4$, flue gas, and hydrocarbon gases. In the field these gases have been employed primarily for pressure maintenance, gas cycling, gravity drainage or multi-contact miscible displacement. Single-well cyclic gas injection is currently primarily restricted to the use of pure $CO_2$ or $CO_2$ contaminated slightly with reservoir gases. Field and laboratory results have been encouraging, but $CO_2$ cannot be feasibly employed in certain circumstances due to transport, economic or corrosion problems. Using consolidated Berea sandstone cores, experiments were performed at immiscible conditions simulating the single-well cyclic gas injection process using different ratios of $CO_2$ with either $N_2$ or $CH_4$. The results were repeatable, and maximum recovery for this oil/rock system was obtained with 5–25% $CO_2$ by volume at reservoir conditions with either $N_2$ or $CH_4$. It is believed that the use of nitrogen and methane together, in combination with carbon dioxide in the percentages indicated, would also produce similar results. Of course, the optimum ratio of $CO_2$ with either $N_2$ or $CH_4$, or mixtures thereof, will depend upon the nature of the specific oil/rock system under consideration.

While not wishing to be bound to any particular theory as to the exact mechanism for the process disclosed herein, the following is an explanation of what is believed to be occurring during the experiments. Laboratory experiments have shown that $CO_2$ is more mobile in porous media than $N_2$ or $CH_4$. The composition of produced gas from cyclic gas stimulation experiments performed by injecting a mixture of 5–50% $CO_2$ and either $CH_4$ or $N_2$ into a Berea sandstone core was determined. The gas that was initially produced was about 80–90% $CO_2$ with the remainder $CH_4$ or $N_2$. As oil production declined, the $CO_2$ concentration decreased and the percent of $CH_4$ or $N_2$ increased, but most of the $CH_4$ or $N_2$ remained in the cores after oil production ceased. In addition, it was noted that a higher pressure differential was required for oil production when $CO_2$ mixtures containing primarily $CH_4$ or $N_2$ were injected as compared to injection of $CO_2$ alone.

It is believed that the injected gas mixture initially travels along high permeability, water-filled channels. The $CO_2$ diffuses into oil contained in areas of the core that were by-passed during the initial waterflood, whereas the less mobile and less soluble $CH_4$ or $N_2$ remains in the high permeability channels. The $CO_2$ swells the oil and reduces its viscosity, thus facilitating recovery of the oil. When water is injected into the backside of the core during the production stage, the nitrogen or methane partially blocks high permeability channels and water is forced into previously by-passed regions of the core. The oil in these by-passed regions has been altered by interaction with $CO_2$ and, consequently, is more mobile than during the initial waterflood. In addition, other experiments have shown that the irreducible oil saturation is lower when oil is in the presence of gas as compared to water. A high saturation of relatively immobile gas would drastically reduce the water saturation in the core and thus improve oil drainage.

It has been generally assumed that maximum oil recovery would be obtained with pure carbon dioxide, and that the more inert gas present, the lower the oil recovery. Instead, we found that a two- to three-fold increase in the recovery of residual oil was obtained as compared to the recovery with pure carbon dioxide, methane or nitrogen. Nitrogen and methane are generally cheaper than carbon dioxide. They are more easily available off-shore or in isolated locations and neither is corrosive. Using a small amount of carbon dioxide with either gas results not only in more oil, but is cheaper, less corrosive and easily transportable due to the smaller amounts of carbon dioxide required. The single-well cyclic process is already an inexpensive tertiary oil recovery process. However, the costs of such processes would further decrease using the method and mixtures described above.

Although the present invention has been described in terms of specific embodiments and procedures, it is anticipated that alterations and modifications thereof will no doubt become apparent to those skilled in the art. It is therefore intended that the following claims be interpreted as covering all such alterations and modifications as fall within the true spirit and scope of the invention.

We claim:

1. A method of recovering oil from an oil-bearing subterranean formation penetrated by a well, comprising the steps of:

(a) injecting via said well a gas mixture into said formation, said gas mixture comprising carbon dioxide and methane; wherein said gas mixture is injected in an amount sufficient to establish in the vicinity of said well a zone of oil in contact with said gas mixture; and wherein said carbon dioxide comprises about 5 percent to about 50 percent by volume at reservoir conditions of said gas mixture;

(b) shutting in said well for a predetermined period of time; and (c) producing said well and recovering said oil from said formation.

2. A method of recovering oil from an oil-bearing subterranean formation penetrated by a well, comprising the steps of:

(a) injecting via said well an mount of carbon dioxide into said formation sufficient to establish in the vicinity of said well a zone of oil in contact with said carbon dioxide;

(b) injecting via said well a gas into said formation, wherein said gas is selected from the group consisting of methane, nitrogen, and mixtures thereof; wherein said injection of said gas forms a gas mixture with said carbon dioxide; and wherein said carbon dioxide comprises about 5 percent to about 50 percent by volume at reservoir conditions of said gas mixture;

(c) shutting in said well for a predetermined period of time; and (d) producing said well and recovering said oil from said formation.

3. The method of claim 2, wherein said gas is methane.

4. The method of claim 2, wherein said gas is nitrogen.

5. The method of claim 2, wherein said carbon dioxide is injected at a pressure below the minimum miscibility pressure of carbon dioxide.

6. The method of claim 2, wherein said gas is injected at a pressure below the minimum miscibility pressure of carbon dioxide.

7. The method of claim 2, wherein the steps described therein are cyclically repeated until further production becomes uneconomical.

* * * * *